US006094926A

United States Patent [19]

Nakayama et al.

[11] Patent Number: 6,094,926

[45] Date of Patent: Aug. 1, 2000

[54] ELECTRICITY STORAGE TYPE AIR CONDITIONING APPARATUS AND COOLING/HEATING SOURCE DEVICE THEREFOR

[75] Inventors: Susumu Nakayama, Shizuoka; Kensaku Oguni, Shimizu; Hiromu Yasuda, Shizuoka; Kenichi Nakamura; Yasutaka Yoshida, both of Shimizu; Tomomi Umeda, Tsuchiura, all of Japan

[73] Assignee: Hitachi, Ltd., Tokyo, Japan

[21] Appl. No.: 09/389,021

[22] Filed: Sep. 2, 1999

[30] Foreign Application Priority Data

Sep. 3, 1998 [JP] Japan ..... 10-249291

[51] Int. Cl.[7] ..... F25B 27/00

[52] U.S. Cl. ..... 62/236; 62/430; 165/237

[58] Field of Search ..... 62/236, 430, 267, 62/231, 201

[56] References Cited

U.S. PATENT DOCUMENTS 4,077,464 3/1978 Moog et al. ..... 62/430 X 5,871,041 2/1999 Rafalovich et al. ..... 62/430 X

*Primary Examiner*—Henry Bennett
*Assistant Examiner*—Chen-Wen Jiang
*Attorney, Agent, or Firm*—Antonelli, Terry, Stout & Kraus, LLP

[57] ABSTRACT

To obtain an electricity storage type air conditioning apparatus which is capable of coping with the improvement in performance of the air conditioner or the needs for increase in cooling load and additional equipment to be installed afterward, by which it becomes possible to easily reduce the power consumption in the daytime even for an existing apparatus in which peak power cut is not considered, and which is suitable to reduce the noise and decrease the size. An electricity storage type air conditioning apparatus comprises a refrigeration cycle system including a compressor, a thermal-source-side heat exchanger, a decompression device and a service-side heat exchanger which are annularly connected by means of pipes to allow a refrigerant to circulate therethrough, a storage battery in which electric power is stored, and a cooling/heating source device by which the refrigerant is cooled and heated between the thermal-source-side heat exchanger and the service-side heat exchanger, the cooling/heating source device being driven with the storage battery.

13 Claims, 3 Drawing Sheets

ELECTRICITY STORAGE TYPE AIR CONDITIONING APPARATUS AND COOLING/HEATING SOURCE DEVICE THEREFOR

BACKGROUND OF THE INVNETION

The present invention relates to an electricity storage type air conditioning apparatus and a cooling/heating source device therefor which utilize electric power stored by making use of night surplus power, and more particularly this invention is suitable to expand the performance of air conditioners using the refrigeration cycle system and to carry out peak power cut to improve the economic efficiency.

Heretofore, it has been known that, in order to cope with the improvement in performance of the air conditioner or the needs for increase in cooling load and additional installation, the liquid piping of the refrigeration cycle system is provided with a heat exchanger so as to carry out heat exchange between a cooling/heating source medium sent from a cooling/heating source device to the heat exchanger and a liquid refrigerant in the liquid piping, as disclosed in JP-A-5-126428, for example.

Further, it is disclosed in JP-A-6-137650, for example, that reduction in power consumption, that is, peak power cut of an air conditioner particularly in the summer daytime is carried out by making use of a storage battery.

Among the prior arts described above, in the apparatus of the type that the cooling/heating source device comprises the refrigeration cycle system, it is impossible to reduce the power consumption in the daytime because driving the cooling/heating source device consumes the power. On the other hand, in the apparatus of the type that the cooling/heating source device utilizes a heat storage tank, it is possible to carry out peak power cut in the daytime but it is difficult to reduce the noise, decrease the size and so on because the refrigeration cycle system is operated to store heat at night.

Further, in the apparatus of the type that the air conditioner is operated in the daytime with the storage battery charged with night surplus power, since the improvement in performance of the refrigeration cycle system is not considered, the power consumption is large and hence the power of the storage battery is used up in a short time. Particularly in the air conditioning apparatus that a plurality of indoor units are connected to an outdoor unit, the performance required varies largely and it is impossible to carry out peak power cut in the daytime satisfactorily. Even if a large number of storage batteries are employed to make the capacity larger in order to overcome these problems, the cost of the storage battery is increased enormously to operate the air conditioner with the storage battery for many hours.

An object of the present invention is to provide an electricity storage type air conditioning apparatus and a cooling/heating source device therefor which are capable of coping with the improvement in performance of the air conditioner or the needs for increase in cooling load and additional equipment to be installed afterward, by which it becomes possible to easily reduce the power consumption in the daytime even for the existing apparatus in which peak power cut is not considered, and which are suitable to reduce the noise and decrease the size.

Another object of the present invention is to provide an electricity storage type air conditioning apparatus and a cooling/heating source device therefor by which it becomes possible to reduce the power consumption in the daytime for many hours, which can be decreased in size and so are suitable for later and additional installation and the like, and which enable the cost of construction to be reduced and the existing piping to be utilized.

Still another object of the present invention is to provide an electricity storage type air conditioning apparatus and a cooling/heating source device therefor which are capable of dealing with the air conditioning apparatus the performance required of which varies largely by compensating the performance or by adding equipment, and by which it becomes possible to carry out peak power cut in the daytime satisfactorily.

The present invention is intended to solve at least one of the problems described above.

SUMMARY OF THE INVENTION

In order to achieve the above objects, according to the present invention, there is provided an electricity storage type air conditioning apparatus comprising: a refrigeration cycle system including a compressor, a thermal-source-side heat exchanger, a decompression device and a service-side heat exchanger which are annularly connected by means of pipes to allow a refrigerant to circulate therethrough; a storage battery in which electric power is stored; and a cooling/heating source device by which the refrigerant is cooled and heated between the thermal-source-side heat exchanger and the service-side heat exchanger, the cooling/heating source device being driven with the storage battery.

With this electricity storage type air conditioning apparatus, either in the cooling- or heating-mode operation, it is possible to reduce the power consumption by cooling or heating the refrigerant by the cooling/heating source device between the thermal-source-side heat exchanger and the service-side heat exchanger and, if the cooling/heating source device is operated in the daytime with the storage battery charged with night surplus power, the power of the storage battery is prevented from being used up in shorter time as compared with the case of being used for directly operating the air conditioner. It is therefore possible to carry out peak power cut in the daytime satisfactorily or for many hours even when the performance required of the air conditioning apparatus varies largely.

Further the cooling/heating source device and the storage battery for driving it can be easily installed later between the thermal-source-side heat exchanger and the service-side heat exchanger, so that even the existing air conditioning apparatus can be easily changed into a peak-power-cut-type one which is capable of reducing the power consumption in the daytime. Moreover, since charging the storage battery is the only one operation which is performed at night, it is not necessary to operate the refrigeration cycle system at night, with the result that the noise can be reduced and the size can be made smaller as compared with the device which employs an ice thermal storage as thermal storage tank.

According to the present invention, there is provided an electricity storage type air conditioning apparatus comprising: a refrigeration cycle system including a compressor, a thermal-source-side heat exchanger, a decompression device and a service-side heat exchanger which are annularly connected by means of pipes to allow a refrigerant to circulate therethrough; a storage battery in which electric power is stored; and a cooling/heating source device provided in parallel with the thermal-source-side heat exchanger, the cooling/heating source device being driven with the storage battery.

Either in the cooling- or heating-mode operation, it is possible to reduce the power consumption by cooling or heating the refrigerant by the cooling/heating source device provided in parallel with the thermal-source-side heat exchanger and, if the cooling/heating source device is operated in the daytime with the storage battery charged with night surplus power, the power of the storage battery is prevented from being used up in shorter time as compared with the case of being used for directly operating the air conditioner. It is therefore possible to carry out peak power cut in the daytime satisfactorily or for many hours.

According to the present invention, there is provided an electricity storage type air conditioning apparatus comprising: a refrigeration cycle system including a compressor, a thermal-source-side heat exchanger, a decompression device and a service-side heat exchanger which are annularly connected by means of pipes to allow a refrigerant to circulate therethrough; a storage battery in which electric power is stored, the storage battery being charged with night surplus power; and a cooling/heating source device which is driven with the storage battery to cool and heat the refrigerant, wherein the power consumption in the daytime is reduced by 15% to 45%.

In accordance with this invention, later and additional installation of the cooling/heating source device and the storage battery for driving it to the existing apparatus is facilitated, and since charging is the only one operation which is performed at night, it is possible to reduce the noise as compared with the device in which the compressor, fan and so on constituting the refrigeration cycle system are operated by making use of ice thermal storage as thermal storage tank, and the cooling/heating source device can be reduced in size because the storage battery can be made smaller than the ice thermal storage.

Preferably, in this invention, if the cooling/heating source device is made by a refrigeration cycle system including a compressor, a thermal-source-side heat exchanger, a decompression device and an auxiliary heat exchanger, the storage battery can be smaller in capacity, which is desirable from the viewpoint of improving the efficiency.

According to the present invention, there is provided an air conditioning apparatus comprising: an outdoor unit; a plurality of indoor units; an auxiliary heat exchanger installed to a liquid pipe connecting between the outdoor unit and the indoor units; a refrigeration cycle system including a compressor, a thermal-source-side heat exchanger, a decompression device and the auxiliary heat exchanger which are connected together; and a storage battery for driving the refrigeration cycle system.

In accordance with this invention, either in the cooling- or heating-mode operation, it is possible to reduce the power consumption by cooling or heating the refrigerant by the auxiliary heat exchanger installed to the liquid pipe connecting between the outdoor unit and the plurality of indoor units and, if the refrigeration cycle system including the compressor, the thermal-source-side heat exchanger, the decompression device and the auxiliary heat exchanger which are connected together, is operated in the daytime with the storage battery charged with night surplus power, the power of the storage battery can be used for many hours. Therefore, it is possible to carry out peak power cut in the daytime satisfactorily or for many hours even when the performance required varies largely as in the case of the air conditioning apparatus comprising a plurality of indoor units. According to the present invention, there is provided an air conditioning apparatus comprising: an outdoor unit; a plurality of indoor units; and a cooling/heating source device installed to a liquid pipe connecting between the outdoor unit and the indoor units and driven with a storage battery, wherein a liquid refrigerant cooled in the outdoor unit is further cooled and then supplied to the plurality of indoor units.

In accordance with this invention, when performing the cooling-mode operation, the liquid refrigerant cooled in the outdoor unit is further cooled by the cooling/heating source device, so that the power consumption can be reduced. And, if the cooling/heating source device is operated in the daytime with the storage battery charged with night surplus power, the power of the storage battery is prevented from being used up in shorter time as compared with the case of being used for directly operating the air conditioner.

According to the present invention, there is provided an air conditioning apparatus comprising an outdoor unit and a plurality of indoor units, wherein a cooling/heating source device which is driven with a storage battery is additionally installed between the outdoor unit and the indoor units and the storage battery is charged with night surplus power and the power consumption in the daytime is reduced.

In accordance with this invention, if the cooling/heating source device and the storage battery for driving it are additionally installed to the existing air conditioning apparatus which is not devised to deal with peak power cut and the storage battery is charged with night surplus power so as to reduce the power consumption in the daytime, the existing air conditioning apparatus can be easily changed into a peak-power-cut-type one. Further, since charging the storage battery is the only one operation which is performed at night, the refrigeration cycle system is not operated at night and as a consequence it is possible to reduce the noise. Moreover, no ice thermal storage tank for ice-making is required differently from the one that ice-making is performed at night with the refrigeration cycle system, and the storage battery can be made smaller than the ice thermal storage tank if the capacities thereof are the same, and therefore the air conditioning apparatus can be reduced in size.

According to the present invention, there is provided a cooling/heating source device which is enabled to be additionally installed later to an air conditioning apparatus having an outdoor unit and a plurality of indoor units, the device being driven with a storage battery to make a refrigerant sent from the outdoor unit to the indoor units undergo heat exchange.

According to the present invention, there is provided a cooling/heating source device which is enabled to be additionally installed later to an air conditioning apparatus having an outdoor unit and a plurality of indoor units and is enabled to be driven with a storage battery, whereby night surplus power is stored and the air conditioning apparatus is made applicable to air conditioning in the daytime.

According to the present invention, there is provided a cooling/heating source device which is driven with a storage battery and installed to a liquid pipe connecting between an outdoor unit and a plurality of indoor units so as to further cool a liquid refrigerant cooled in the outdoor unit and then supply it to the indoor units.

Preferably, the cooling/heating source device is a refrigeration cycle system including a compressor, a thermal-source-side heat exchanger, a decompression device and an auxiliary heat exchanger.

DESCRIPTION OF PREFERRED EMBODIMENTS

Now, description will be given of embodiments of the present invention with reference to the drawings.

Figure 1:
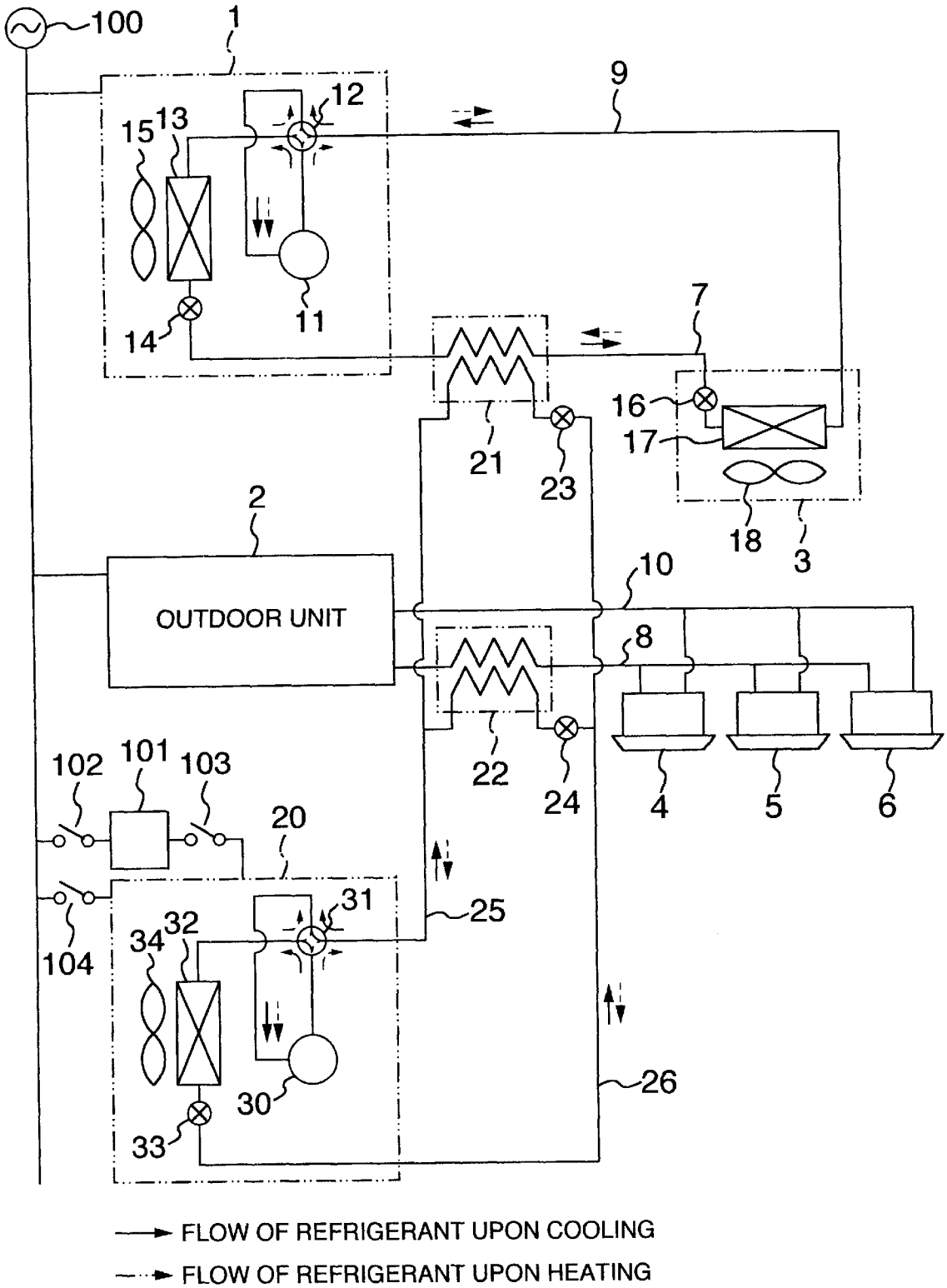
FIG. 1 is a system diagram of an embodiment of an air conditioning apparatus according to the present invention.

FIG. 1 shows an air conditioner comprising an outdoor unit 1 and an indoor unit 3 which are connected by means of a liquid pipe 7 and a gas pipe 9, and another air conditioner comprising an outdoor unit 2 and three indoor units 4, 5, 6 which are connected by means of a liquid pipe 8 and a gas pipe 10. The outdoor unit 1 comprises a compressor 11, a four-way valve 12, an outdoor heat exchanger (thermal-source-side heat exchanger) 13, a control valve 14 and an outdoor fan 15, while the indoor unit 3 comprises a control valve 16, an indoor heat exchanger (service-side heat exchanger) 17 and an indoor fan 18. The outdoor unit 2 and the indoor units 4, 5, 6 are respectively the same as the outdoor unit 1 and the indoor unit 3.

The liquid pipes 7, 8 are provided with heat exchangers 21, 22 as cooling/heating source device and the heat exchangers 21, 22 may be later installed in existing air conditioners. Further, pipes 25, 26 are connected to the heat exchangers 21, 22 through control valves 23, 24. The pipes 25, 26 are connected to a cooling/heating source device 20 having a refrigeration cycle system which comprises a compressor 30, a four-way valve 31, a heat exchanger 32, a control valve 33 and a fan 34. The cooling/heating source device 20 is not limited to the one having the refrigeration cycle system but may be the ones using a thermo-heater, Peltier element and so on.

Next, operations of various parts will be described.

When performing the cooling-mode operation, a refrigerant flows in the direction of arrows of solid line in FIG. 1. High-pressure gas refrigerant discharged from the compressor 11 passes through the four-way valve 12 and flows into the outdoor heat exchanger 13 where it is condensed into liquid refrigerant through heat exchange with the open air with the help of the outdoor fan 15. The liquid refrigerant passes through the control valve (expansion valve) 14 whose opening degree is made large and then flows through the liquid pipe 7 so as to be sent to the indoor unit 3. In the indoor unit 3, the liquid refrigerant is reduced in pressure by the control valve (expansion valve) 16 whose opening degree is made small and then enters the indoor heat exchanger 17 where it undergoes heat exchange with the air in the room with the aid of the indoor fan 18. At this time, the air in the room is cooled and the refrigerant evaporates into low-pressure gas refrigerant and is returned to the outdoor unit 1 through the gas pipe 9.

Figure 2:
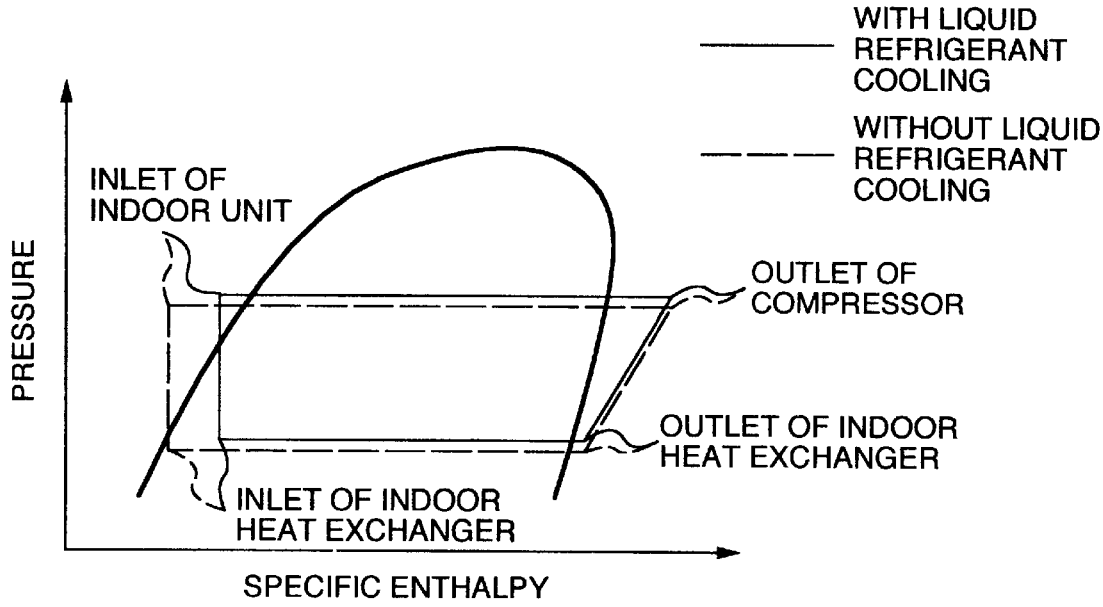
FIG. 2 is a Mollier diagram showing the effects obtained at the time of the cooling-mode operation.

The low-pressure gas refrigerant returned to the outdoor unit 1 is drawn into the compressor 11 through the four-way valve 12. A Mollier diagram for this refrigerant at the time of the cooling-mode operation is shown by solid lines in FIG. 2. Incidentally, the cooling-mode operation of the air conditioner comprising the outdoor unit 2 and the three indoor units 4, 5, 6 is performed in the same manner, as well.

When performing the cooling-mode operation, if the refrigerant is supplied from the cooling/heating source device 20 to the heat exchangers 21, 22 so that the liquid refrigerant is cooled between the outdoor unit 1 and the indoor unit 3 or between the outdoor unit 2 and the indoor units 4, 5, 6 by performing heat exchange between the refrigerant from the cooling/heating source device 20 and the liquid refrigerant, the degree of supercooling of the liquid refrigerant is increased. A Mollier diagram for this liquid refrigerant is shown by broken lines in FIG. 2. Namely, an increase in degree of supercooling of the liquid refrigerant causes the specific enthalpy of the liquid refrigerant to become small and the latent heat of vaporization of the refrigerant to increase, so that the cooling performance of the air conditioner is enhanced.

The operating capacity of the compressor 11 can be reduced by an amount corresponding to an increment in cooling performance, so that the discharge pressure is lowered, leading to a sharp reduction in power consumption. And, if the refrigeration cycle system of the cooling/heating source device 20 is enabled to be driven with a storage battery 101 and the cooling/heating source device 20 is operated in the daytime with the storage battery 101 charged with night surplus power, the power of the storage battery 101 can be prevented from being used up in a short time.

Figure 3:
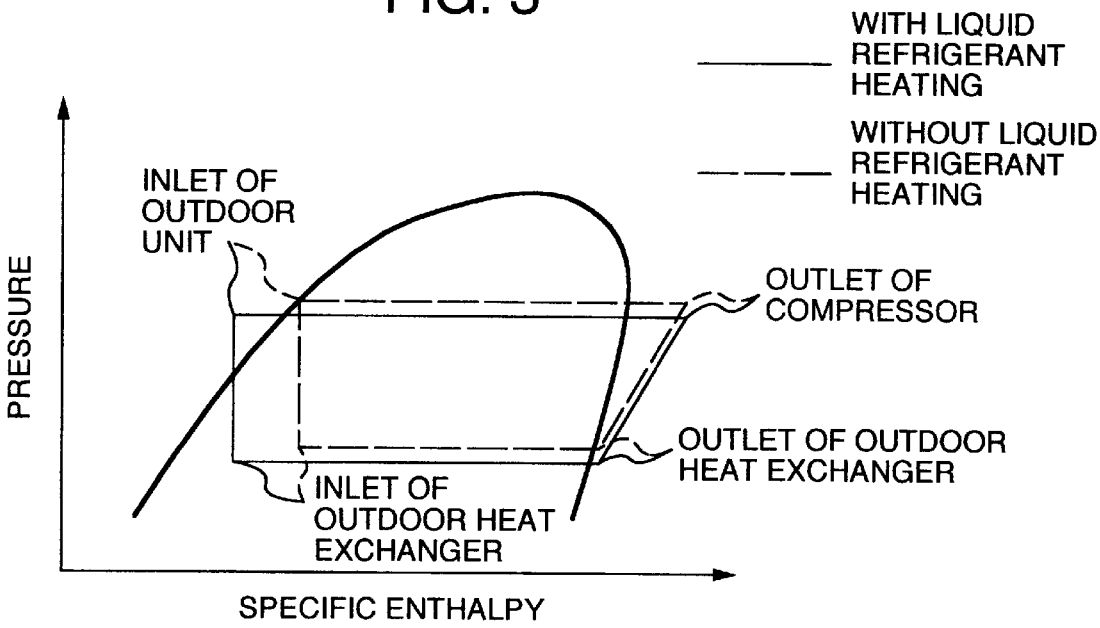
FIG. 3 is a Mollier diagram showing the effects obtained at the time of the heating-mode operation.

When performing the heating-mode operation, the refrigerant flows in the direction of arrows of broken line. High-pressure gas refrigerant discharged from the compressor 11 passes through the four-way valve 12 and flows into the gas pipe 9 so as to enter the indoor unit 3. In the indoor unit 3, the gas refrigerant undergoes heat exchange with the air in the room by means of the indoor heat exchanger 17 with the help of the indoor fan 18. As a result, the air in the room is warmed and the refrigerant is condensed into liquid refrigerant. The liquid refrigerant passes through the control valve 16 whose opening degree is made large and flows into the liquid pipe 7 so as to be sent to the outdoor unit 1. In the outdoor unit 1, the liquid refrigerant is reduced in pressure by the control valve 14 whose opening degree is made small. It then enters the outdoor heat exchanger 13 where it undergoes heat exchange with the open air with the aid of the outdoor fan 15. As a result, the refrigerant evaporates into low-pressure gas refrigerant which is drawn into the compressor 11 through the four-way valve 12. The heating-mode operation of the air conditioner comprising the outdoor unit 2 and the three indoor units 4, 5, 6 is performed in the same manner, as well. A Mollier diagram for the refrigerant at the time of the heating-mode operation is shown by solid lines in FIG. 3.

If the refrigerant is supplied from the cooling/heating source device 20 to the heat exchangers 21, 22 so that the liquid refrigerant is subjected to heat exchange between the outdoor unit 1 and the indoor unit 3 or between the outdoor unit 2 and the indoor units 4, 5, 6, the degree of supercooling of the liquid refrigerant is decreased or the degree of dryness is increased. A Mollier diagram for this liquid refrigerant is shown by broken lines in FIG. 3. Namely, a decrease in degree of supercooling of the liquid refrigerant or an increase in degree of dryness causes the specific enthalpy of the liquid refrigerant to become small. The latent heat of vaporization of the refrigerant decreases, and the degree of superheat at the outlet of the outdoor heat exchanger 13 or the degree of superheat of the gas discharged from the compressor becomes large. For this reason, the opening degree of the control valve 14 is increased so that the degree of superheat is so controlled as to be equal to the predetermined value. This causes the evaporation pressure to rise, the specific volume of the refrigerant drawn into the compressor to become small, an amount of circulating refrigerant to increase, and the discharge pressure to rise, and therefore the heating performance is enhanced.

And, in the same way as in the cooling-mode operation, since the refrigeration cycle system of the cooling/heating source device 20 is driven with the storage battery 101, if the cooling/heating source device 20 is operated in the daytime with the storage battery 101 charged with night surplus power, the power of the storage battery 101 can be prevented from being used up in a short time. Therefore it is possible to carry out peak power cut, which enables the power consumption in the daytime to be reduced, satisfactorily or for many hours.

Next, operation of the cooling/heating source device 20 will be described in detail.

When cooling the liquid refrigerant of the air conditioner, the four-way valve 31 is made to be in the state shown by solid lines. As a result, high-pressure gas refrigerant discharged from the compressor 30 passes through the four-way valve 31 and enters the heat exchanger 32 where the refrigerant undergoes heat exchange with the open air with the aid of the fan 34. The gas refrigerant is condensed into liquid refrigerant. The liquid refrigerant then passes through the control valve 33 and flows into the pipe 26. The liquid refrigerant is reduced in pressure while it passes through the control valves 23, 24 whose opening degrees are made small, and then enters the heat exchangers 21, 22 where it undergoes heat exchange with the liquid refrigerant in the liquid pipes 7, 8. At this time, the liquid refrigerant left the outdoor unit 1 is cooled and increased in the degree of supercooling. Meanwhile, the refrigerant sent from the cooling/heating source device 20 evaporates into low-pressure gas refrigerant which flows through the pipe 25 and returns to the cooling/heating source device 20 where it passes through the four-way valve 31 and then is drawn into the compressor 30.

When heating the liquid refrigerant of the air conditioner, the four-way valve 31 is changed to be in the state shown by broken lines. As a result, high-pressure gas refrigerant discharged from the compressor 30 passes through the four-way valve 31. It flows into the pipe 25 so as to enter the heat exchangers 21, 22 where it undergoes heat exchange with the liquid refrigerant in the liquid pipes 7, 8. At this time, the liquid refrigerant is heated and reduced in the degree of supercooling. In other words, the degree of dryness is increased. The refrigerant sent from the cooling/heating source device 20 is condensed into liquid refrigerant. The liquid refrigerant passes through the control valves 23, 24 whose opening degrees are made large and flows into the pipe 26 so as to return to the cooling/heating source device 20. The liquid refrigerant entered the cooling/heating source device 20 is reduced in pressure by the control valve 33 whose opening degree is made small. It then enters the heat exchanger 32 where it undergoes heat exchange with the open air with the help of the fan 34 and evaporates into low-pressure gas refrigerant which passes through the four-way valve 31 and then is drawn into the compressor 30. It should be noted that an amount of flow of the refrigerant flowing into the heat exchangers 21, 22 can be regulated by adjusting the opening degrees of the control valves 23, 24.

It is advisable that the air conditioners are driven with a commercial power supply 100 and the cooling/heating source device 20 is driven with the storage battery 101 or the commercial power supply 100. When the cooling/heating source device 20 is driven with the storage battery 101, a switch 103 is turned on and a switch 104 is turned off. When the cooling/heating source device 20 is driven with the commercial power supply 100, the switch 103 is turned off and the switch 104 is turned on. Further, when the storage battery 101 is charged, a switch 102 is turned on and the switches 103, 104 are turned off.

If the cooling/heating source device 20 is driven in the daytime with the storage battery 101 charged with night surplus power, it is possible to reduce the power consumption and use the power of the storage battery 101 for many hours. Particularly in an air conditioning apparatus in which a plurality of indoor units are connected to an outdoor unit, the variation of the required performance is large, but it is not necessary even to increase the capacity of the storage battery to cope with this.

Since the cooling/heating source device 20 can be driven with the storage battery 101, the power consumption in the daytime depends only on the air conditioner, and therefore it is possible to improve the performance without increasing the power consumption. Further, by reducing the operating capacity of the compressor 1 or 30 by an amount corresponding to an increment in performance, it is possible to reduce the power consumption in the daytime while securing the performance. Moreover, charging the storage battery 101 with night surplus power causes little noises, because no moving mechanical parts such as the compressor and the refrigeration cycle system are operated.

In addition, the cooling/heating source device 20 is driven only for cooling and heating the liquid refrigerant of the air conditioner, so that it uses less electric power as compared with the air conditioner and the power of the storage battery 101 never be used up in a short time. For instance, when reducing the power consumption in the daytime by 20%, it will do for the cooling/heating source device 20 to improve the performance of the air conditioner by 20%. Assuming that the COPs (coefficient of performance=performance/power) of the air conditioner and the cooling/heating source device are equal to each other, the power consumption of the cooling/heating source device is 20% of that of the air conditioner and hence the storage battery can last five times as long as in the case of being used to operate the air conditioner.

Furthermore, it is suitable, from the viewpoints of the duration of peak power cut, downsizing of the storage battery 101 and so on, to reduce the power consumption in the daytime by 15% to 45% by utilizing the storage battery 101 which is charged with night surplus power. And, it becomes easy for the cooling/heating source device 20 and the storage battery 101 for driving it to be additionally installed later to an existing air conditioning apparatus, and even the increase of the indoor units 4, 5, 6 in itself is facilitated.

Figure 4:
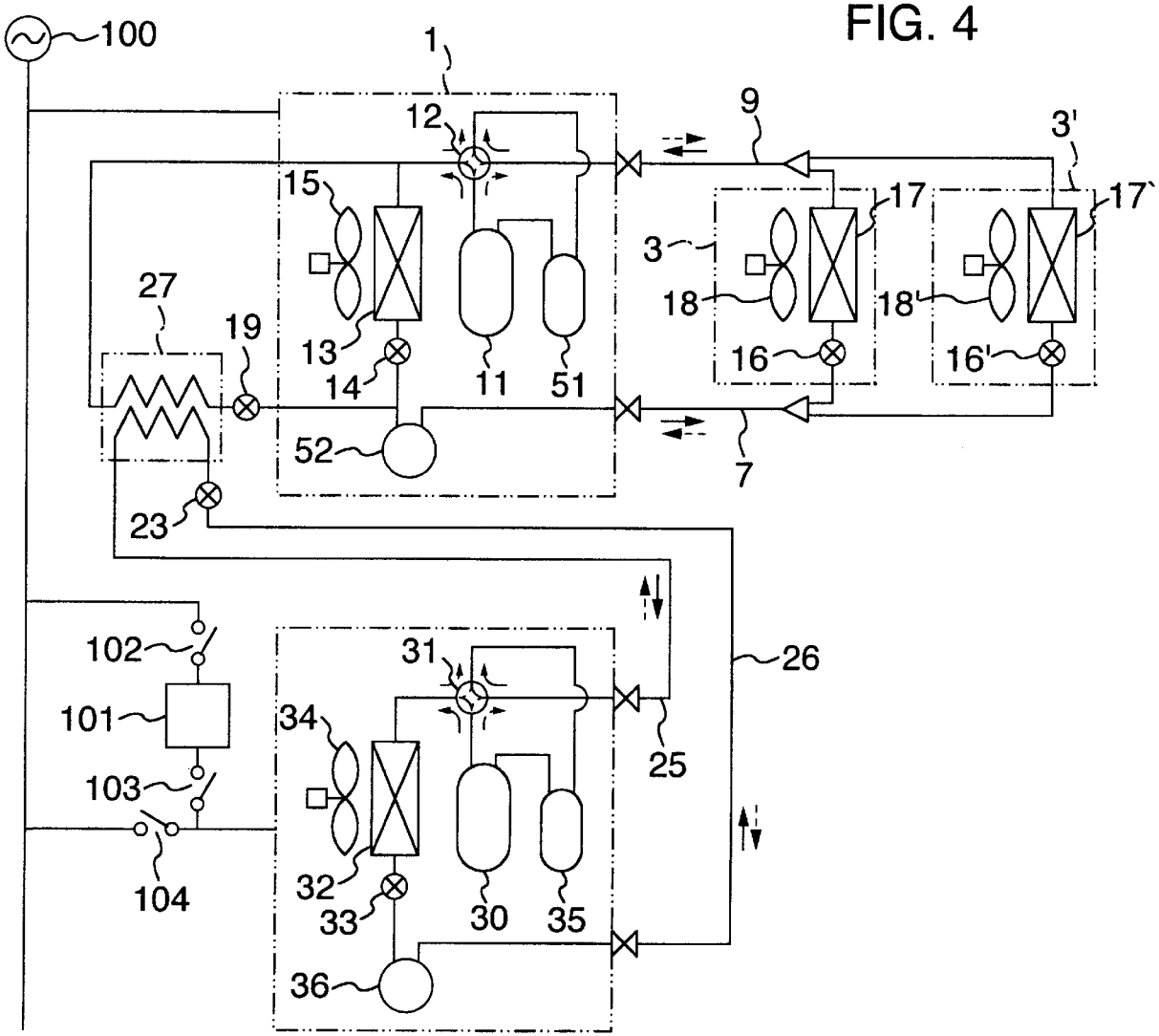
FIG. 4 is a system diagram of another embodiment of an air conditioning apparatus according to the present invention.

FIG. 4 shows another embodiment of the present invention. In the embodiment, an outdoor unit 1 and indoor units 3, 3' are connected by means of a liquid pipe 7 and a gas pipe 9, and the outdoor unit 1 comprises a compressor 11, a four-way valve 12, an outdoor heat exchanger 13, a control valve 14, an outdoor fan 15, an accumulator 51 and a liquid tank 52. Further, an auxiliary heat exchanger 27 and a control valve 19 are provided in parallel with the outdoor heat exchanger 13 and the control valve 14.

The indoor units 3, 3' respectively comprise control valves 16, 16', indoor heat exchangers 17, 17' and indoor fans 18, 18', and to the auxiliary heat exchanger 27 are connected a pipe 26 through a control valve 23 and a pipe 25. The pipes 25, 26 are connected to a cooling/heating source device 20. The cooling/heating source device 20 comprises a compressor 30, a four-way valve 31, a heat exchanger 32, a control valve 33, a fan 34, an accumulator 35 and a liquid tank 36.

Next, description will be given of the operation. When the air conditioner performs the cooling-mode operation, a refrigerant flows in the direction of arrows of solid line. High-pressure gas refrigerant discharged from the compressor 11 passes through the four-way valve 12 and flows into the outdoor heat exchanger 13 and the auxiliary heat exchanger 27. The refrigerant flowed in the outdoor heat exchanger 13 undergoes heat exchange with the open air with the help of the outdoor fan 15 so as to be condensed into liquid refrigerant. The refrigerant flowed in the auxiliary heat exchanger 27 is cooled with the refrigerant of the cooling/heating source device 20 so as to be condensed into liquid refrigerant. The liquid refrigerant passes through the control valves 14, 19 whose opening degrees are made large and the liquid tank 52 and then flows through the liquid pipe 7 so as to be sent to the indoor units 3, 3'. In the indoor units 3, 3', the liquid refrigerant is reduced in pressure by the control valves 16, 16' whose opening degrees are made small, and then enters the indoor heat exchangers 17, 17' where it undergoes heat exchange with the air in the room with the aid of the indoor fans 18, 18', respectively. At this time, the air in the room is cooled, while the refrigerant evaporates into low-pressure gas refrigerant and is returned through the gas pipe 9 to the outdoor unit 1.

The low-pressure gas refrigerant returned to the outdoor unit 1 passes through the four-way valve 12 and the accumulator 51 and then is drawn into the compressor 11. High-pressure gas refrigerant discharged from the compressor 30 of the cooling/heating source device 20 passes through the four-way valve 31 and then enters the heat exchanger 32 where it undergoes heat exchange with the open air with the help of the fan 34. As a result, the refrigerant is condensed into liquid refrigerant and is made to pass through the control valve 33 whose opening degree is made large and the liquid tank 36 and then flows into the pipe 26. The liquid refrigerant flows from the pipe 26 into the control valve 23 whose opening degree is made small so as to be reduced in pressure, and then enters the auxiliary heat exchanger 27 where it undergoes heat exchange with the refrigerant of the air conditioner.

The refrigerant evaporates into low-pressure gas refrigerant which is returned through the pipe 25 to the cooling/heating source device 20 where it passes through the four-way valve 31 and the accumulator 35 and then is drawn into the compressor 30. In the auxiliary heat exchanger 27, the refrigerant of the air conditioner is condensed by cooling with the refrigerant of the cooling/heating source device 20, and therefore the discharge pressure of the compressor 11 can be lowered and the power consumption of the air conditioner can be reduced. Regulation of the discharge pressure is performed by controlling the operating capacity of the compressor 30 of the cooling/heating source device 20.

When performing the heating-mode operation, the refrigerant flows in the direction of arrows of broken line. The high-pressure gas refrigerant discharged from the compressor 11 passes through the four-way valve 12 and flows into the gas pipe 9 so as to enter the indoor units 3, 3'. In the indoor units 3, 3', the gas refrigerant undergoes heat exchange with the air in the room by means of the heat exchangers 17, 17' with the aid of the indoor fans 18, 18', respectively, with the result that the air in the room is warmed, while the refrigerant is condensed into liquid refrigerant. The liquid refrigerant passes through the control valves 16, 16' whose opening degrees are made large and then flows into the liquid pipe 7 so as to be sent to the outdoor unit 1. In the outdoor unit 1, the liquid refrigerant is reduced in pressure by the control valves 14, 19 whose opening degrees are made small and then enters the outdoor heat exchanger 13 and the auxiliary heat exchanger 27.

The refrigerant entered the outdoor heat exchanger 13 undergoes heat exchange with the open air with the help of the outdoor fan 15 so as to be evaporated, while the refrigerant entered the auxiliary heat exchanger 27 is evaporated by being heated with the refrigerant of the cooling/heating source device 20. The low-pressure gas refrigerant thus evaporated passes through the four-way valve 12 and the accumulator 51 and then is drawn into the compressor 11. The high-pressure gas refrigerant discharged from the compressor 30 of the cooling/heating source device 20 flows through the four-way valve 31 and then flows into the pipe 25 so as to enter the auxiliary heat exchanger 27 where it undergoes heat exchange with the refrigerant of the air conditioner. At this time, the refrigerant is condensed into liquid refrigerant and is returned through the control valve 23 and the pipe 26 to the cooling/heating source device 20. The liquid refrigerant returned to the cooling/heating source device 20 passes through the liquid tank and, after being reduced in pressure by the control valve 31, then enters the heat exchanger 32 where it undergoes heat exchange with the open air so as to evaporate into low-pressure gas refrigerant. The low-pressure gas refrigerant passes through the four-way valve 31 and the accumulator 35 and then is drawn into the compressor 30.

The air conditioner is driven with a commercial power supply 100 and the cooling/heating source device 20 is driven with a storage battery 101 or the commercial power supply 100. When the cooling/heating source device 20 is driven with the storage battery 101, a switch 103 is turned on and a switch 104 is turned off. When the cooling/heating source device 20 is driven with the commercial power supply 100, the switch 103 is turned off and the switch 104 is turned on. Further, when the storage battery 101 is charged, a switch 102 is turned on and the switches 103, 104 are turned off.

In the embodiments shown in FIGS. 1 and 4, the air conditioner is operated with the commercial power supply, but it may be operated with another storage battery charged with night surplus power. In this case, the power consumption of the air conditioner is already reduced by the function of the cooling/heating source device 20, and therefore the duration of the operation of the air conditioner with the storage battery 101 can be made longer as compared with the case where the air conditioner alone is operated with the storage battery 101. Further, it is possible to operate the air conditioning system without using the commercial power supply at all during this operation. If the power of the storage battery 101 for the air conditioner is used up, changeover to the commercial power supply will cause the air conditioner to be operated while carrying out peak power cut.

As has been described above, according to the present invention, the cooling/heating source device, by which the refrigerant is cooled or heated between the thermal-source-side (outdoor) heat exchanger and the service-side (indoor) heat exchanger, can be driven with the storage battery, and therefore if the cooling/heating source device is operated in the daytime with the storage battery charged with night surplus power, the power consumption of the air conditioner can be reduced either in the cooling- or heating-mode operation, and the power required of the storage battery can be made smaller as compared with the case of being used to directly operate the air conditioner. In consequence, it is possible to carry out peak power cut in the daytime satisfactorily or for many hours.

Further, according to the present invention, the refrigerant is cooled or heated by the cooling/heating source device provided in parallel with the thermal-source-side (outdoor) heat exchanger so as to reduce the power consumption, and therefore if the cooling/heating source device is operated in the daytime with the storage battery charged with night surplus power, the power of the storage battery never be used up in shorter time as compared with the case where the air conditioner is operated directly with the storage battery, with the result that it is possible to carry out peak power cut for many hours.

Moreover, according to the present invention, the cooling/heating source device, by which the refrigerant is cooled or heated, is driven with the storage battery so as to reduce the power consumption in the daytime by 15% to 45%, so that, by installing later the cooling/heating source device to an existing apparatus which is not devised to deal with peak power cut, the existing apparatus can be easily changed into a peak-power-cut-type one, and since charging is the only one operation which is performed at night, it is possible to reduce the noise as compared with the device in which the compressor, fan and so on constituting the refrigeration cycle system are operated by using ice thermal storage as thermal storage tank, for example.

In addition, according to the present invention, the liquid pipe connecting between the outdoor unit and the indoor unit is provided with the auxiliary heat exchanger and the refrigeration cycle system to which the auxiliary heat exchanger is connected is enabled to be driven with the storage battery, and therefore the power consumption can be reduced by cooling or heating the refrigerant by the auxiliary heat exchanger when performing the cooling- or heating-mode operation and, if the refrigeration cycle system to which the auxiliary heat exchanger is connected is operated in the daytime with the storage battery charged with night surplus power, it is possible to carry out peak power cut utilizing the power of the storage battery for many hours.

Besides, according to the present invention, the liquid pipe connecting between the outdoor unit and the indoor unit is provided with the cooling/heating source device driven with the storage battery so that the liquid refrigerant cooled in the outdoor unit is further cooled and then supplied to a plurality of indoor units, and therefore the power consumption is reduced and, by operating the cooling/heating source device in the daytime with the storage battery charged with night surplus power, it is possible to utilize the power of the storage battery for many hours.

Furthermore, according to the present invention, the cooling/heating source device driven with the storage battery is additionally installed between the outdoor unit and the indoor unit and the storage battery is charged with night surplus power so as to reduce the power consumption in the daytime, and therefore even an existing air conditioning apparatus which is not devised to deal with peak power cut can be easily changed into an air conditioning apparatus of peak power cut type.

What is claimed is:

1. An electricity storage type air conditioning apparatus comprising: a refrigeration cycle system including a compressor, a thermal-source-side heat exchanger, a decompression device and a service-side heat exchanger which are annularly connected by means of pipes to allow a refrigerant to circulate therethrough; a storage battery in which electric power is stored; and a cooling/heating source device by which said refrigerant is cooled and heated between said thermal-source-side heat exchanger and said service-side heat exchanger, said cooling/heating source device being driven with said storage battery, said cooling/heating source device including a refrigeration system.

2. An electricity storage type air conditioning apparatus comprising: a refrigeration cycle system including a compressor, a thermal-source-side heat exchanger, a decompression device and a service-side heat exchanger which are annularly connected by means of pipes to allow a refrigerant to circulate therethrough; a storage battery in which electric power is stored; and a cooling/heating source device provided in parallel with said thermal-source-side heat exchanger, said cooling/heating source device being driven with said storage battery, said cooling/heating source device including a refrigeration system.

3. An electricity storage type air conditioning apparatus comprising: a refrigeration cycle system including a compressor, a thermal-source-side heat exchanger, a decompression device and a service-side heat exchanger which are annularly connected by means of pipes to allow a refrigerant to circulate therethrough; a storage battery in which electric power is stored, said storage battery being charged with night surplus power; and a cooling/heating source device which is driven with said storage battery to cool and heat said refrigerant, wherein the power consumption in the daytime is reduced by 15% to 45%.

4. An electricity storage type air conditioning apparatus according to claim 1, wherein said refrigeration system of said cooling/heating device includes a compressor, a thermal-source-side heat exchanger, a decompression device and an auxiliary heat exchanger.

5. An electricity storage type air conditioning apparatus comprising: an air conditioner having an outdoor unit and a plurality of indoor units; an auxiliary heat exchanger installed to a liquid pipe connecting between said outdoor unit and said indoor units; a refrigeration cycle system including a compressor, a thermal-source-side heat exchanger, a decompression device and said auxiliary heat exchanger which are connected together; and a storage battery for driving said refrigeration cycle system.

6. An electricity storage type air conditioning apparatus comprising: an air conditioner having an outdoor unit and a plurality of indoor units; and a cooling/heating source device installed to a liquid pipe connecting between said outdoor unit and said indoor units and driven with a storage battery, wherein a liquid refrigerant cooled in said outdoor unit is further cooled and then supplied to said plurality of indoor units, said cooling/heating source device including a refrigeration system.

7. An electricity storage type air conditioning apparatus comprising an outdoor unit and a plurality of indoor units, characterized in that a cooling/heating source device which is driven with a storage battery is additionally installed between said outdoor unit and said indoor units so as to reduce the power consumption in the daytime by charging said storage battery with night surplus power.

8. A cooling/heating source device which is enabled to be additionally installed later to an air conditioning apparatus having an outdoor unit and a plurality of indoor units, said device being driven with a storage battery to make a refrigerant sent from said outdoor unit to said indoor units undergo heat exchange, said device including a refrigeration system.

9. A cooling/heating source device according to claim 8, wherein said refrigeration system includes a compressor, a thermal-source-side heat exchanger, a decompression device and an auxiliary heat exchanger.

10. A cooling/heating source device which is enabled to be additionally installed later to an air conditioning apparatus having an outdoor unit and a plurality of indoor units and is enabled to be driven with a storage battery, whereby night surplus power is stored and said air conditioning apparatus is made applicable to air conditioning in the daytime.

11. A cooling/heating source device according to claim 10, wherein said cooling/heating source device comprises a refrigeration cycle system including a compressor, a thermal-source-side heat exchanger, a decompression device and an auxiliary heat exchanger.

12. A cooling/heating source device which is driven with a storage battery, said cooling/heating source device being installed to a liquid pipe connecting between an outdoor unit and a plurality of indoor units so as to further cool a liquid refrigerant cooled in said outdoor unit and then supply it to said indoor units.

13. A cooling/heating source device according to claim 12, wherein said cooling/heating source device comprises a refrigeration cycle system including a compressor, a thermal-source-side heat exchanger, a decompression device and an auxiliary heat exchanger.

* * * * *